United States Patent [19]

Jungkind et al.

[11] 4,060,257

[45] Nov. 29, 1977

[54] HEEL RETAINER FOR SAFETY SKI-BINDINGS

[75] Inventors: Roland Jungkind, Garmisch-Partenkirchen; Gerhard Sedlmair, Farchant, both of Germany

[73] Assignee: Hannes Marker, Garmisch-Partenkirchen, Germany

[21] Appl. No.: 704,626

[22] Filed: July 12, 1976

[30] Foreign Application Priority Data

Feb. 27, 1976 Germany ..... 2608073

[51] Int. Cl.[2] ..... A63C 9/08

[52] U.S. Cl. ..... 280/626

[58] Field of Search ..... 280/626

[56] References Cited

U.S. PATENT DOCUMENTS

| | | | |
|---|---|---|---|
| 3,575,438 | 4/1971 | Unger | 280/626 |
| 3,608,918 | 9/1971 | Heckl | 280/626 |
| 3,637,227 | 1/1972 | Ramillon | 280/626 |
| 3,768,822 | 10/1973 | Kanno | 280/626 |
| 3,961,801 | 6/1976 | Korger | 280/626 |

*Primary Examiner*—Robert R. Song

*Attorney, Agent, or Firm*—Fleit & Jacobson

[57] ABSTRACT

A heel retainer for a safety ski-binding comprises a housing for attachment to the ski and a holder for engaging the sole of a ski boot. The sole holder is pivoted to the housing by a shaft displaceable in slots of the housing extending substantially parallel to the ski and is held in a sole-engaging or sole-releasing position by a first spring. A second spring biases the pivot shaft in the slots towards the ski tip. A pivotable entrainment member for the sole holder is engaged by said first spring. The sole holder is suspended from the entrainment member by a pin and slot connection.

9 Claims, 4 Drawing Figures

HEEL RETAINER FOR SAFETY SKI-BINDINGS

The invention relates to a heel retainer for a safety ski-binding comprising a supporting member for fixing to a ski, a sole holder pivoted to the supporting member about a horizontal transverse shaft and displaceable in slots substantially parallel to the ski, a closing pedal on the sole holder, a first spring between the sole holder and supporting member for keeping the sole holder in the operative or open position, a handle for deliberately relieving the sole holder, and a second spring biassing the transverse shaft of the sole holder at least approximately in the direction of the slots in the supporting member towards the ski tip.

Such heel retainers are for example known from DT-PS 1,578,959. Compared with other known heel retainers of simple construction, they have the advantage that separate springs are provided for pressing the boot against a front jaw and for offering resistance to becoming released. In this way one avoids the frequently undesired dependence of the pressure on the ski boot varying as a function of the releasing force when the latter is adjusted. However, it has hitherto been possible to achieve this advantage only by means of an expensive and complicated construction which prevents the cheap production of such heel retainers.

Another disadvantage of the heel retainer of the aforementioned kind is caused by the comparatively close mounting of the sole holder to the surface of the ski. Within a long so-called damping path, such closed mounting results in a comparatively large component of movement in the longitudinal direction of the ski of the part of the sole holder that presses on the sole and consequently there is considerable friction between this part and the rim of the sole.

It is an object of the present invention to construct and simplify a heel retainer of the aforementioned kind so that the aforementioned disadvantages are avoided without detrimentally influencing its safety function.

According to the invention, a heel retainer for a safety ski-binding comprises a supporting member for fixing to a ski, a sole holder pivoted to the supporting member about a horizontal transverse shaft and displaceable in slots substantially parallel to the ski, a closing pedal on the sole holder, a first spring between the sole holder and supporting member for keeping the sole holder in the operative or open position, a handle for deliberately relieving the sole holder, and a second spring biassing the transverse shaft of the sole holder at least approximately in the direction of the slots in the supporting member towards the ski tip, wherein the supporting member is in the form of a housing and contains an entrainment member for the sole holder, which entrainment member is pivotable about a horizontal transverse pivot, said sole holder being suspended from said entrainment member by means of a slot and horizontal transverse pin provided one on each of said holder and entrainment member, said first spring engaging said entrainment member.

In contrast with known heel retainers, none of the functional or supporting components of the heel retainer other than the sole holder can move in a direction parallel to the length of the ski. By means of the invention, the pivotal shaft for the sole holder can be disposed at an elevation within the housing so that, when the sole is lifted within an elastic range before becoming released, there will be practically no movement of the sole holder lengthwise of the ski.

Desirably, the second spring is disposed above the first spring within the housing. Despite the favourable disposition of the sole holder, this will then enable a shallow construction of the heel retainer to be obtained.

Advantageously, the first spring is connected to the entrainment member by way of a two-armed lever and a coupling member, said lever being pivotable in the housing about a shaft parallel to said horizontal transverse shaft. In this case, the entrainment member may contain a cam recess for a slide roller on the coupling member, there being provided for the slide roller a retaining lug which is fixed with respect to the housing and extends towards the cam recess. The retaining lug preferably contains two steps which, together with the entrainment member, define a respective rest position for the slide roller, in one of which the sole holder will be in its operative condition and in the other of which it will be in its open condition.

According to another aspect of the present invention, in a heel retainer of the aforementioned kind the first spring may be a helical tension spring having at an end adjacent the housing an eye which is offset with respect to the spring axis and is suspended from a retaining pin, the retaining pin extending at right-angles to the spring axis and being unrotatably mounted in the housing with the possibility of adjustment lengthwise of the spring by means of a screw. The retaining pin is preferably supported by the housing beyond the screw as viewed from the eye. Further, the screw can have a head supported against the housing and a shank extending through the wall of the housing and the retaining pin into the spring. This results in a compact construction.

The invention will now be described with reference to an example illustrated in the accompanying drawings, wherein.

Figure 3:
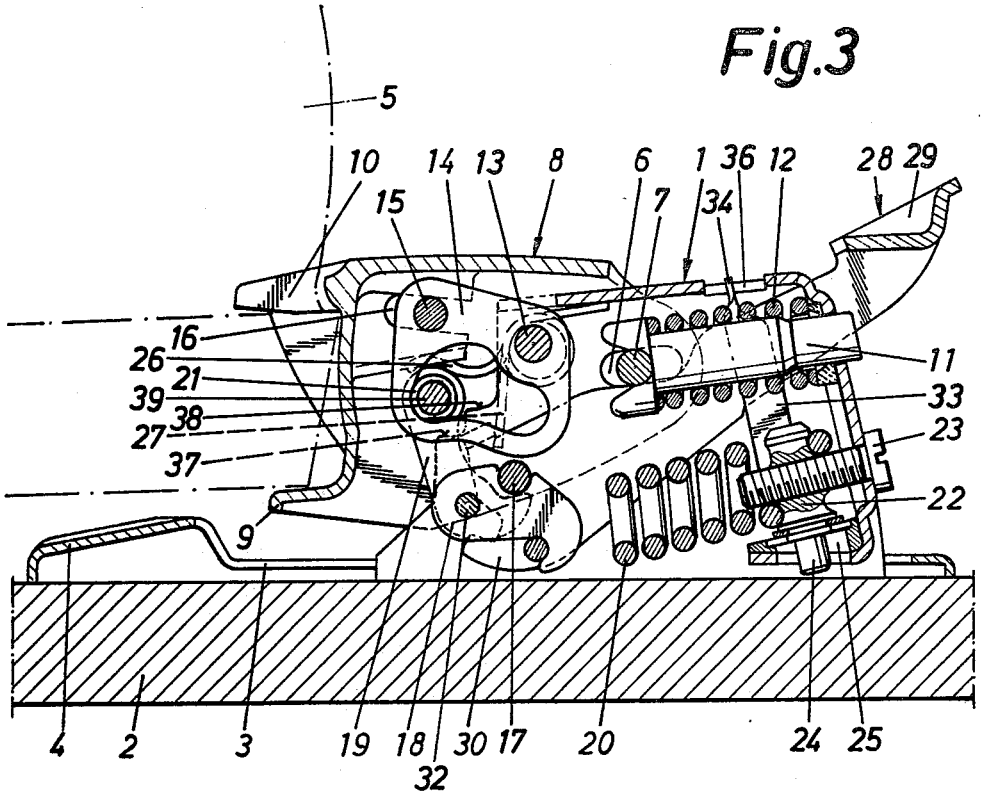
FIG. 3 is a view similar to FIG. 1 but showing the heel retainer at the instant immediately prior to release.

The illustrated heel retainer comprises a housing 1 secured to a ski 2 by means of screws, namely with the aid of a clamping plate 3 which is formed with treads 4 for the rear end of the sole of a ski boot 5 that is indicated in FIG. 3 in chain-dotted lines. In each side wall, the housing is provided with a slot 6 extending substantially parallel to the ski, a transverse shaft 7 being pivotably and displaceably mounted in these slots. Secured to the transverse shaft 7 there is a sole holder 8 which comprises a closing pedal 9 and the sole-engaging portion of which is designated 10. The transverse shaft 7 is under the influence of a helical compression spring 12 with the interpositioning of a supporting pin 11. The spring 12 is supported by the rear wall of the housing and consequently the shaft 7 will always be located in the front limiting position as viewed in FIG. 1 when there is no ski boot in the binding.

An entrainment member 14 for the sole holder is pivotably mounted in the housing 1 about a horizontal transverse shaft 13. This entrainment member carries a horizontal transverse pin 15 to which the sole holder 8 is suspended with the aid of outwardly open slots 16. A helical tension spring 20 engages the entrainment member 14 with the interpositioning of a coupling member 19 and a two-armed lever 18 which is pivotably mounted in the housing 1 about a shaft 17 parallel to the transverse shaft 7. The coupling member 19 is suspended in a cam recess of the entrainment member by means of a slide roller 21.

The eye of the tension spring 20 adjacent the housing is displaced with respect to the axis of the spring and suspended from a retaining pin 22 disposed at right-angles to the spring axis. This retaining pin is adjustable lengthwise of the spring by means of a screw 23 of which the lead is supported by the rear wall of the housing and the shank extends through the wall of the housing and through the retaining pin into the tension spring 20. Beyond the screw, as viewed from the position of the eye, the retaining pin is supported against the housing, and a reduced end 24 engages in a slot 25 so that it is secured against rotation when the screw 23 is turned.

Figure 2:
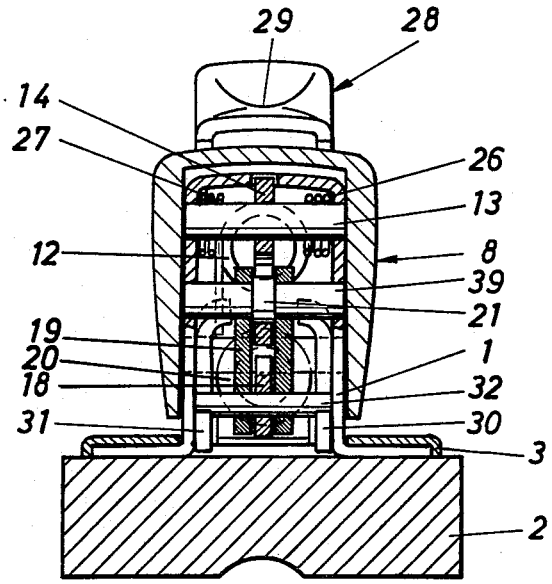
FIG. 2 is a cross-section on the line II—II in FIG. 1.

Two coiled bending springs 26, 27 (see especially FIG. 2) are mounted on the transverse shaft 13 for the entrainment member 14. Both springs are supported with their respective one limb against the upper wall of the housing 1. The second limb of the spring 26 acts against the sole holder 8 whilst the second limb of the spring 27 acts against an opening or releasing lever 28 which is provided in the form of a handle and is mounted on the shaft 17. This opening lever is substantially U-shaped, the web 29 of the U containing a depression for inserting the tip of a ski stick. Below the shaft 17 (see especially FIG. 2), the two limbs 30, 31 are in the form of entrainment members for engaging the hinge pin 32 between the lever 18 and the coupling member 19 so that, on depressing the opening lever 28 against the force of the tension spring 20, the coupling member is lifted, whereby the entrainment member 14 and the sole holder 8 are relieved from the force of the tension spring 20.

Connected to the retaining pin 22 that is suspended from the tension spring 22 there is a tongue 33 of which the free end 34 is offset and constitutes a pointer which extends into a slot 36 of the upper wall of the housing 1 and serves to indicate the set releasing force.

Figure 4:
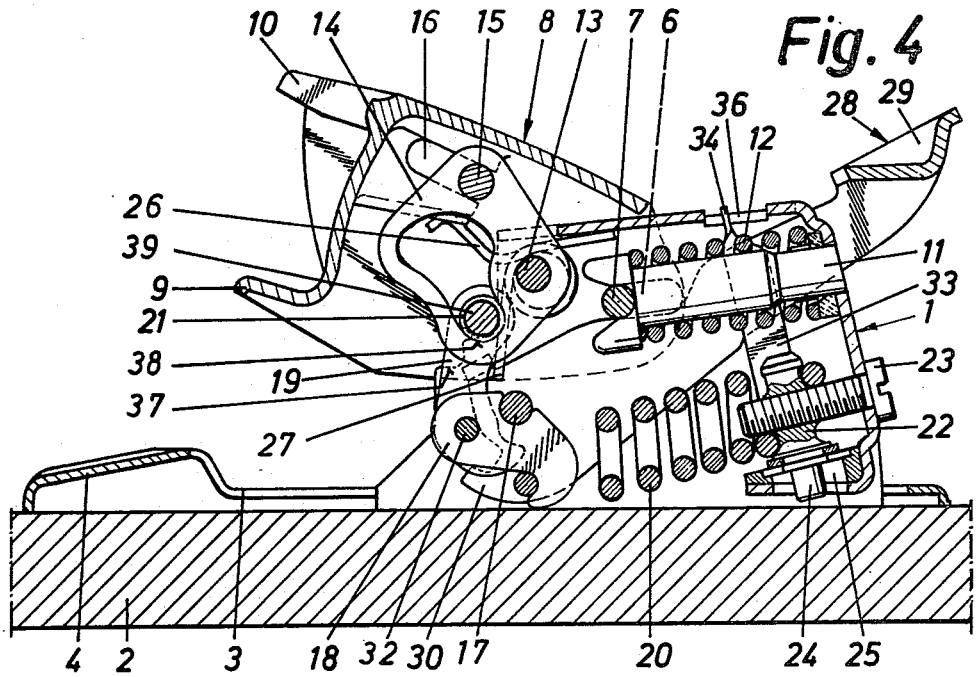
FIG. 4 is a view similar to FIGS. 1 and 3 but showing the heel retainer in the open condition.

The ends of the side walls of the housing 1 adjacent the sole holder are formed in the region of the cam recess as a two-step retaining tongue 37, 38 for the supporting pin 39 of the slide roller 21. Both steps cooperate with the entrainment member 14 to define a rest position for the slide roller for fixing the sole holder 8. The step 37 determines the rest position of the sole holder (FIG. 1) whilst the step 38 determines the open position of the sole holder (FIG. 4).

Figure 1:
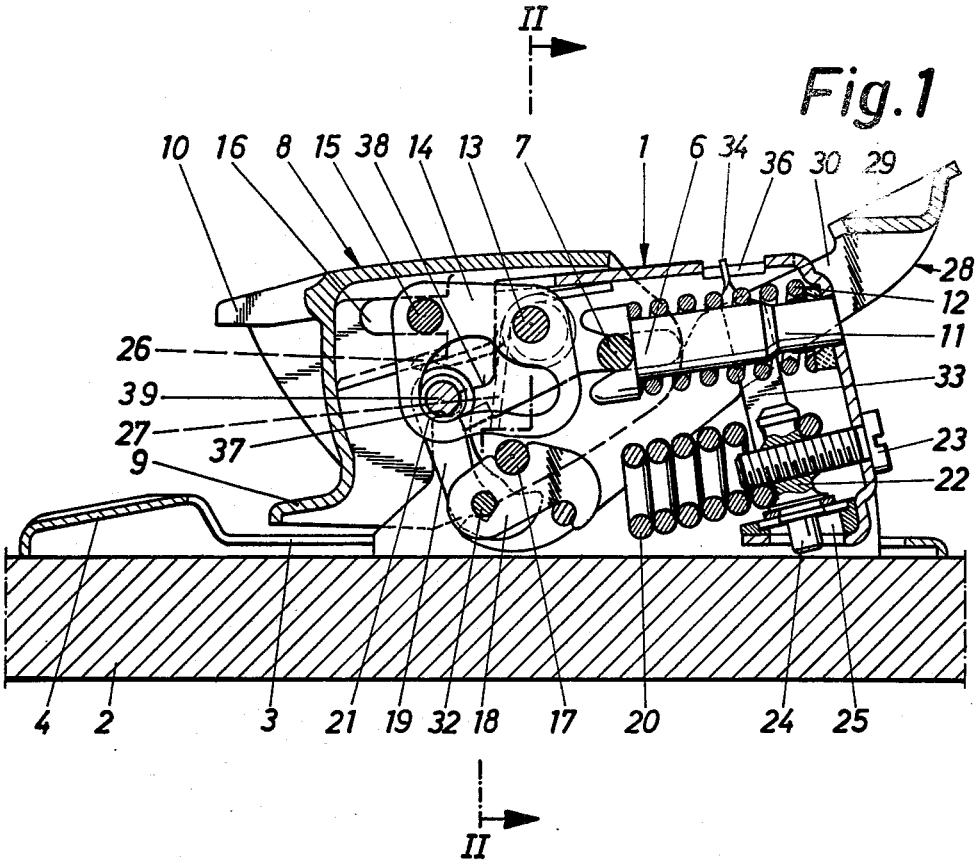
FIG. 1 is a central longitudinal section of a heel retainer.

Accordingly, FIG. 1 illustrates the heel retainer with the sole holder 8 located in its rest position. Since there is no ski boot in the binding, the transverse shaft 7 is disposed at the left-hand end of the slot. It is preferably in this position that the heel retainer is also transported and stored. To introduce a ski boot in the binding, the opening lever 28 is first of all actuated so that, under the influence of the coiled bending spring 26, the sole holder 8 can move to the open position of FIG. 4. During this movement, the supporting pin 39 for the slide roller 21 runs onto the step 38 of the holding tongue and is secured in this position against running off the step by means of the entrainment member 14 holding the slide roller. On introduction of the ski boot in the binding, the rear end of the sole comes into contact with the closing pedal 9 and swings the sole holder 8 to the operative position. The sole-engaging part 10 of the sole holder will be spaced from the surface of the ski depending on the thickness of the sole of the ski boot. Adjustment of the part 10 is not required to adapt the heel retainer to different sole thicknesses. On swinging of the sole holder 8, the entrainment member 14 is carried along and the appropriately shaped cam recess permits movement of the slide roller 21 whereby the supporting pin 39 can slide from the step 38 of the retaining tongue.

On the occurrence of an upwardly directed force on the sole holder 8 that exceeds the prestress of the tension spring 20, the sole holder moves upwardly. The entrainment member necessarily follows this movement and carries the slide roller 21 with it along a predetermined path. If this path is exceeded by an appropriately large applied force, the slide roller 21 rolls along the cam recess of the entrainment member and its supporting pin 39 engages the upper step 38 of the retaining tongue, which step fixes the open position of the sole holder.

We claim:

1. A heel retainer for a safety ski-binding, comprising a supporting member, means for fixing said supporting member to a ski, a sole holder, means for pivoting said sole holder to the supporting member about a horizontal transverse shaft and means for displacing said sole holder in slots substantially parallel to the ski, said sole holder comprising a closing pedal, a first spring means positioned between the sole holder and supporting member for keeping the sole holder in the operative or open position, a handle means for deliberately relieving the sole holder, and a second spring means for biassing said transverse shaft of the sole holder at least approximately in the direction of the slots in the supporting member towards the ski tip, wherein said supporting member comprises a housing and an entrainment member means for the sole holder, a horizontal transverse pivot shaft, means for pivoting said entrainment member means about said pivot shaft, suspending means for suspending said sole holder from said entrainment member means comprising a slot and a horizontal transverse pin respectively provided on said sole holder and entrainment member means, wherein said first spring means engages said entrainment member means.

2. A heel retainer according to claim 1, wherein said second spring means is disposed above the first spring means in said housing.

3. A heel retainer according to claim 1, wherein said first spring means engages the entrainment member means comprising a two-armed lever and a coupling member, means for pivoting said two-armed lever about a shaft mounted in the housing parallel to said horizontal transverse shaft.

4. A heel retainer according to claim 3, wherein said entrainment member means contains a cam recess, said coupling member comprises a slide roller on the coupling member said slide roller positioned within said cam recess.

5. A heel retainer according to claim 4, further comprising a retaining lug means for retaining the slide roller, said lug means fixed with respect to the housing and extending towards the cam recess.

6. A retaining member according to claim 5, wherein said retaining lug means contains two steps.

7. A heel retainer according to claim 1, wherein said first spring means comprises a helical tension spring having, at an end adjacent the housing, an eye offset with respect to the first spring axis, a retaining pin extending at right-angles to the first spring axis unrotatably mounted in the housing, means for suspending said tension spring from said retaining pin, and means for lengthwise adjustment of the tension spring comprising a screw.

8. A heel retainer according to claim 7, wherein said retaining pin is mounted in the housing beyond the screw with respect to the eye of the tension spring.

9. A heel retainer according to claim 7, wherein said screw has a head supported against the housing and a shank extending through the wall of the housing, through the retaining pin, and into the tension spring.

* * * * *